US009837751B2

(12) United States Patent
Lai et al.

(10) Patent No.: US 9,837,751 B2
(45) Date of Patent: Dec. 5, 2017

(54) CONNECTOR COVER AND CONNECTOR ASSEMBLY

(71) Applicant: GIGA-BYTE TECHNOLOGY CO.,LTD., New Taipei (TW)

(72) Inventors: Chih-Ming Lai, New Taipei (TW); Yung-Shun Kao, New Taipei (TW)

(73) Assignee: GIGA-BYTE TECHNOLOGY CO., LTD., New Taipei (TW)

( * ) Notice: Subject to any disclaimer, the term of this patent is extended or adjusted under 35 U.S.C. 154(b) by 0 days.

(21) Appl. No.: 14/975,859

(22) Filed: Dec. 21, 2015

(65) Prior Publication Data

US 2017/0125935 A1 May 4, 2017

(30) Foreign Application Priority Data

Nov. 4, 2015 (TW) ..... 104136251 A

(51) Int. Cl.

| | |
|---|---|
| ***H01R 13/648*** | (2006.01) |
| ***H01R 13/46*** | (2006.01) |
| ***H01R 12/73*** | (2011.01) |
| ***H01R 13/6597*** | (2011.01) |
| ***H01R 12/71*** | (2011.01) |
| ***H01R 13/516*** | (2006.01) |

(Continued)

(52) U.S. Cl.

CPC ..... *H01R 13/46* (2013.01); *H01R 12/716* (2013.01); *H01R 12/737* (2013.01); *H01R 13/516* (2013.01); *H01R 13/6581* (2013.01); *H01R 13/6594* (2013.01); *H01R 13/6597* (2013.01)

(58) Field of Classification Search

CPC ..... H01R 12/7076

USPC ..... 439/630, 629, 607.37, 607.54, 607.02

See application file for complete search history.

(56) References Cited

U.S. PATENT DOCUMENTS 5,443,403 A * 8/1995 Weidler ..... H01R 13/518 439/557

5,478,259 A * 12/1995 Noschese ..... H01R 12/721 439/108

(Continued)

FOREIGN PATENT DOCUMENTS

TW M294139 7/2006

OTHER PUBLICATIONS

"Office Action of Taiwan Counterpart Application", dated Feb. 16, 2017, p. 1-p. 8, in which the listed references ere cited.

(Continued)

*Primary Examiner* — Tulsidas C Patel
*Assistant Examiner* — Peter G Leigh
(74) *Attorney, Agent, or Firm* — JCIPRNET

(57) ABSTRACT

A connector cover is adapted to cover a connector and be fixed to a main board. The connector includes a connector top surface having a connector slot, a connector bottom surface and four connector laterals. The connector cover includes a cover top surface, four cover laterals, at least one bending pin and at least one connecting pin.

The four cover laterals are adapted to cover the four connector laterals, and two of the cover laterals are connected to the cover top surface. The bending pin extends from the cover lateral and is adapted to be bent to lean against the connector bottom surface. The connecting pin extends from the cover lateral. The connector cover is connected to the main board through the connecting pin. A connector assembly is further provided.

10 Claims, 5 Drawing Sheets

(51) Int. Cl.
*H01R 13/6581* (2011.01)
*H01R 13/6594* (2011.01)

(56) References Cited

U.S. PATENT DOCUMENTS 6,050,852 A * 4/2000 Wu ..... H01R 13/629 439/607.02
6,056,560 A * 5/2000 Wu ..... H01R 23/6873 439/108
6,080,016 A 6/2000 Ho et al.
6,093,046 A * 7/2000 Chiou ..... H01R 12/7005 439/378
6,319,060 B1 * 11/2001 Wu ..... H01R 23/6873 439/108
6,379,186 B1 * 4/2002 Shi ..... H01R 23/6873 439/569
6,485,328 B1 * 11/2002 Wu ..... H01R 23/6873 439/567
6,551,120 B2 * 4/2003 Daskalakis ..... G06F 1/184 439/157
6,663,402 B1 * 12/2003 Yu ..... H01R 13/65802 439/108
6,672,887 B1 * 1/2004 Yu ..... H01R 13/65802 439/108
6,749,445 B1 * 6/2004 Chen ..... H05K 3/301 439/65
6,755,690 B1 * 6/2004 Zhang ..... H01R 23/6873 439/607.02
6,821,149 B2 * 11/2004 Lai ..... H01R 23/6873 439/607.31
6,908,339 B2 * 6/2005 Tanaka ..... H01R 12/707 439/564
7,008,267 B2 * 3/2006 Fan ..... H01R 23/6873 439/108
7,044,779 B1 * 5/2006 Liu ..... H01R 24/62 439/540.1
7,083,470 B2 * 8/2006 Zhang ..... H01R 23/6873 439/607.36
D582,860 S * 12/2008 Sasaki ..... D13/147
7,771,232 B2 * 8/2010 Si ..... H01R 23/6873 439/607.01
8,444,438 B2 * 5/2013 Gao ..... H01R 13/6582 439/607.35
8,944,850 B2 * 2/2015 Simmel ..... H01R 43/20 439/607.55
2005/0095913 A1 5/2005 Fan
2005/0277334 A1 * 12/2005 Huang ..... H01R 23/6873 439/607.01
2006/0264103 A1 11/2006 Wei
2010/0167584 A1 * 7/2010 He ..... H01R 13/506 439/607.01
2013/0045631 A1 2/2013 Wang
2015/0255898 A1 * 9/2015 Yincheng ..... H01R 11/01 439/628
2015/0255919 A1 * 9/2015 Yano ..... H01R 13/6205 439/39
2015/0380858 A1 * 12/2015 Kao ..... H01R 13/658 439/620.22

OTHER PUBLICATIONS

"Office Action of European Counterpart Application," dated Dec. 13, 2016, p. 1-p. 9, in which the listed references were cited.

* cited by examiner

CONNECTOR COVER AND CONNECTOR ASSEMBLY

CROSS-REFERENCE TO RELATED APPLICATION

This application claims the priority benefit of Taiwan application serial no. 104136251, filed on Nov. 4, 2015. The entirety of the above-mentioned patent application is hereby incorporated by reference herein and made a part of this specification.

BACKGROUND OF THE INVENTION

1. Field of the Invention

The invention relates to a connector cover and a connector assembly, and particularly relates to a connector cover and a connector assembly capable of enhancing a strength of the connector.

2. Description of Related Art

With the advance of science and technology in recent years, the performance of the expansion device in the computer host is continuously improved. Taking memory module as an example, when a memory module is operated in a high performance mode, a considerable amount of heat is generated. In order to facilitate the dissipation of heat, a fan may be disposed at a side of a high-level memory module to promptly dissipate the heat generated by the chip on the memory module through convention. However, since this kind of memory module is heavier, when the memory module is inserted into the connector on the main board, the housing of the connector may be broken. Moreover, there may be signal interference between the connector and other electronic components.

SUMMARY OF THE INVENTION

The invention provides a connector cover capable of enhancing a strength of a connector and reducing signal interference.

The invention provides a connector assembly having the connector cover.

A connector cover according to an embodiment of the invention is adapted to cover a connector and be fixed to a main board. The connector includes a connector top surface and a connector bottom surface opposite to each other and four connector laterals respectively connected to the connector top surface and the connector bottom surface. The connector top surface includes a connector slot. The connector cover includes a cover top surface, four cover laterals, at least one bending pin, and at least one connecting pin. The cover top surface is adapted to cover the connector top surface and includes a cover slot corresponding to the connector slot. The four cover laterals cover four the connector laterals. In addition, the two opposite cover laterals are connected to the cover top surface. The at least one bending pin extends from one of the cover laterals and is adapted to be bent to lean against the connector bottom surface. The connecting pin extends from one of the cover laterals. The connector cover is adapted to be connected to the main board through the at least one connecting pin.

A connector assembly according to an embodiment of the invention includes a connector and a connector cover. The connector is adapted to be fixed to a main board and includes a connector top surface, a connector bottom surface, and four connector laterals. The connector top surface includes a connector slot. The connector bottom surface is opposite to the connector top surface. The connector laterals are respectively connected to the connector top surface and the connector bottom surface. The connector cover includes a cover top surface, four cover laterals, at least one bending pin, and at least one connecting pin. The cover top surface covers the connector top surface and includes a cover slot corresponding to the connector slot. The four cover laterals cover the four connector laterals. In addition, the two opposite cover laterals are connected to the cover top surface. The at least one bending pin extends from one of the cover laterals. In addition, the at least one bending pin is bent to lean against the connector bottom surface. The at least one connecting pin extends from one of the cover laterals. In addition, the connector cover is connected to the main board through the at least one connecting pin.

According to an embodiment of the invention, one of the connector laterals of the connector includes a first fixing part, and one of the cover laterals of the connector cover includes a second fixing part corresponding to the first fixing part.

According to an embodiment of the invention, the first fixing part includes a recessed area, the second fixing part includes a suspending arm tilting toward the opposite cover lateral, and the suspending aim is adapted to lean against a wall of the recessed area.

According to an embodiment of the invention, the connecting pin is a grounding pin.

According to an embodiment of the invention, each connecting pin has a rough surface, a bending part, or a breach, and the rough surface includes a surface subjected to a sand blasting treatment or includes a plurality of regular or irregular patterns or bumps.

According to an embodiment of the invention, at least one of the cover laterals includes a plane and a rib protruding from or recessed with respect to the plane.

Based on the above, in the connector cover of the connector assembly of according to the embodiments of the invention, the connected cover laterals cover the connector laterals of the connector, such that the connector cover is refrained from back-and-forth or lateral movement with respect to the connector. The cover top surface covers the connector top surface, and the bending pins lean against the connector bottom surface, such that the connector cover is refrained from vertical movement with respect to the connector. Accordingly, the connector cover is fixed to the connector in the respective directions. The connector cover may be further firmly connected to the main board through the connecting pins by soldering. The connector cover fixed to the connector and the main board effectively enhances the strength of the connector. In addition, the metallic material of the connector cover further reduces the signal interferences between the connector and other electronic components on the main board.

In order to make the aforementioned and other features and advantages of the invention comprehensible, several exemplary embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
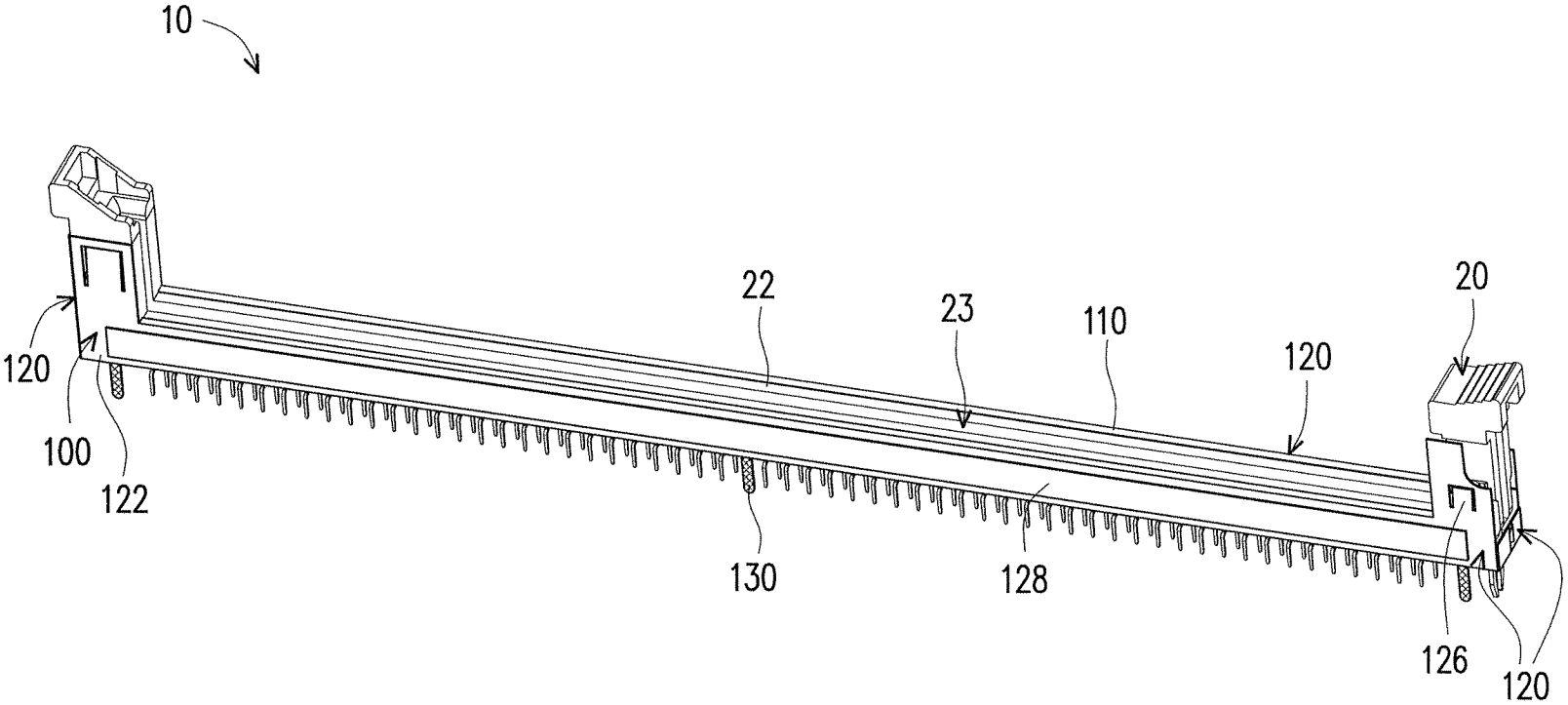
FIG. 1 is a schematic view illustrating a connector assembly according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
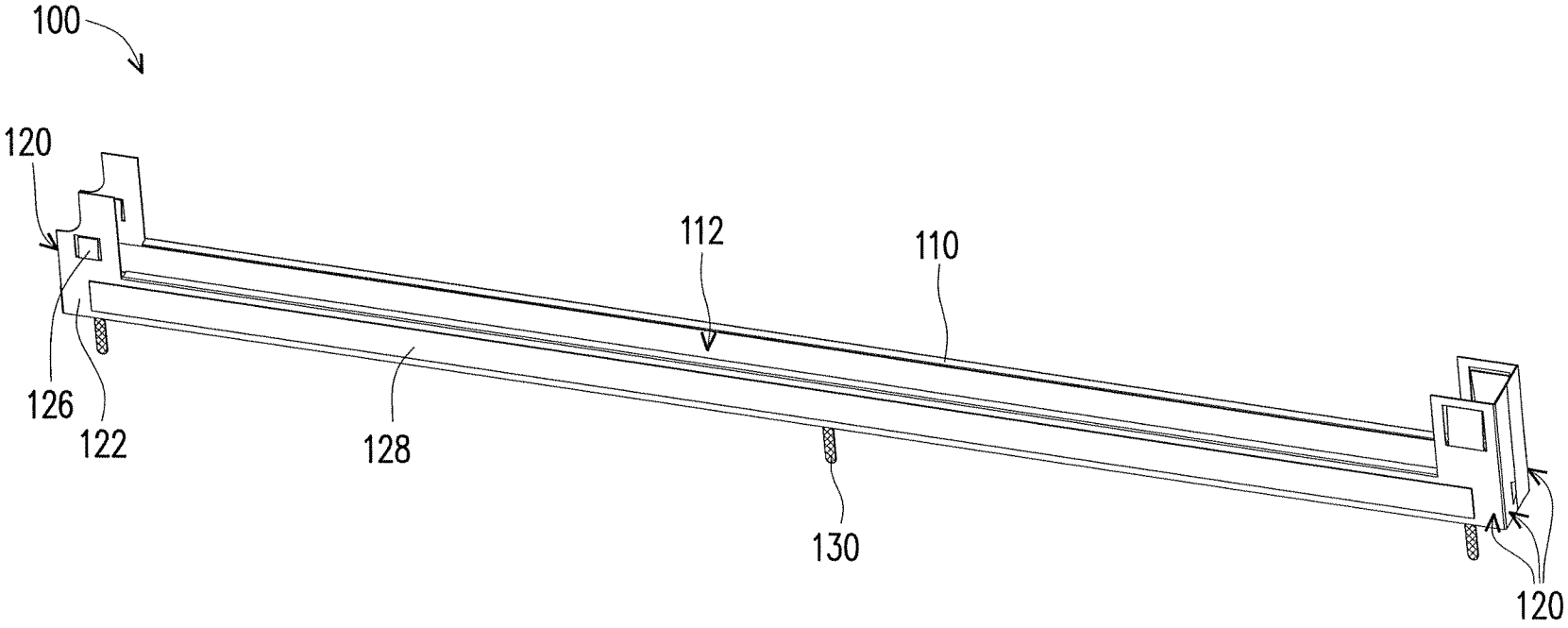
FIG. 2 is a schematic view illustrating a connector cover shown in FIG. 1.
Figure 3:
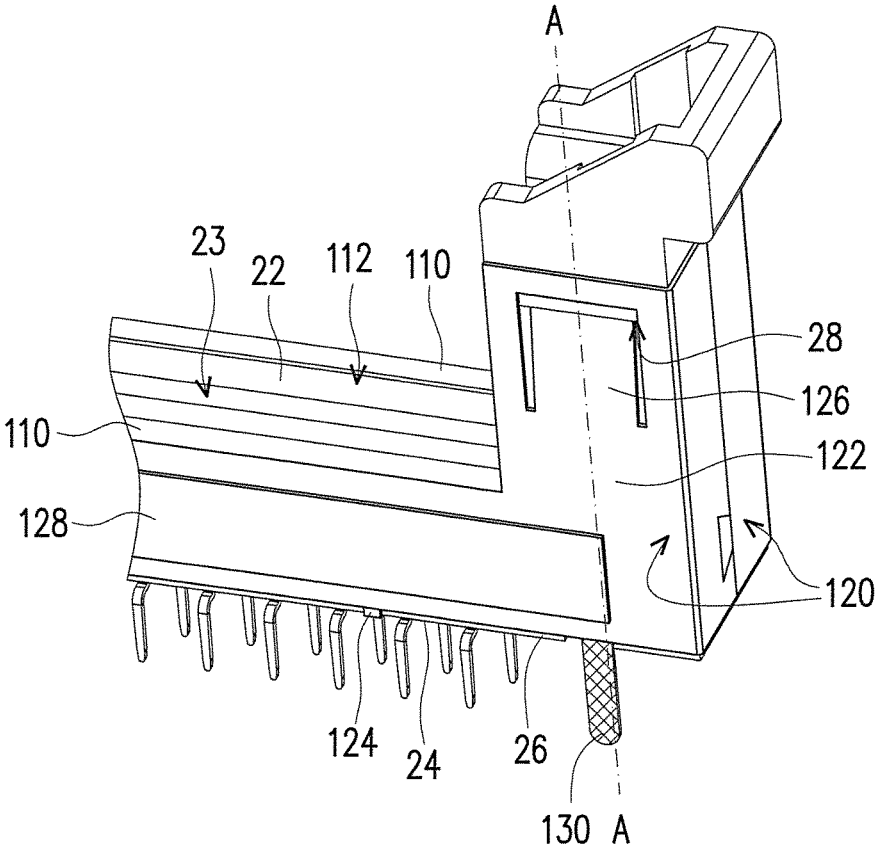
FIG. 3 is a partially enlarged schematic view of FIG. 1.
Figure 4:
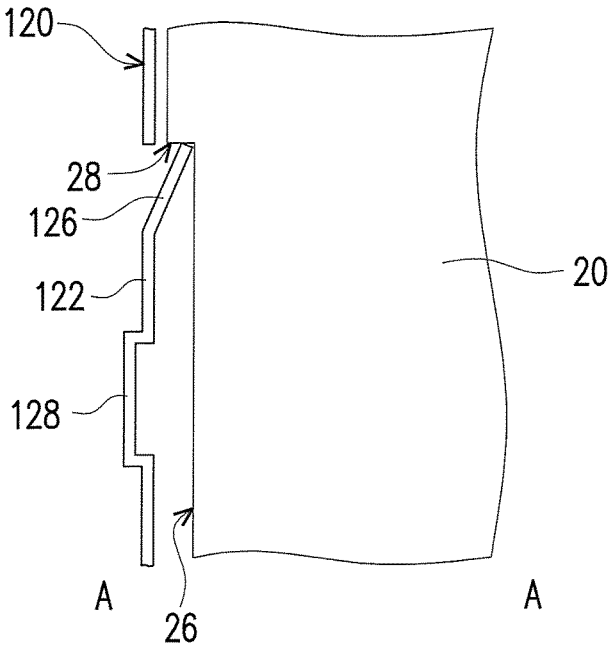
FIG. 4 is a partial schematic cross-sectional view taken along line A-A of FIG. 3.
Figure 5:
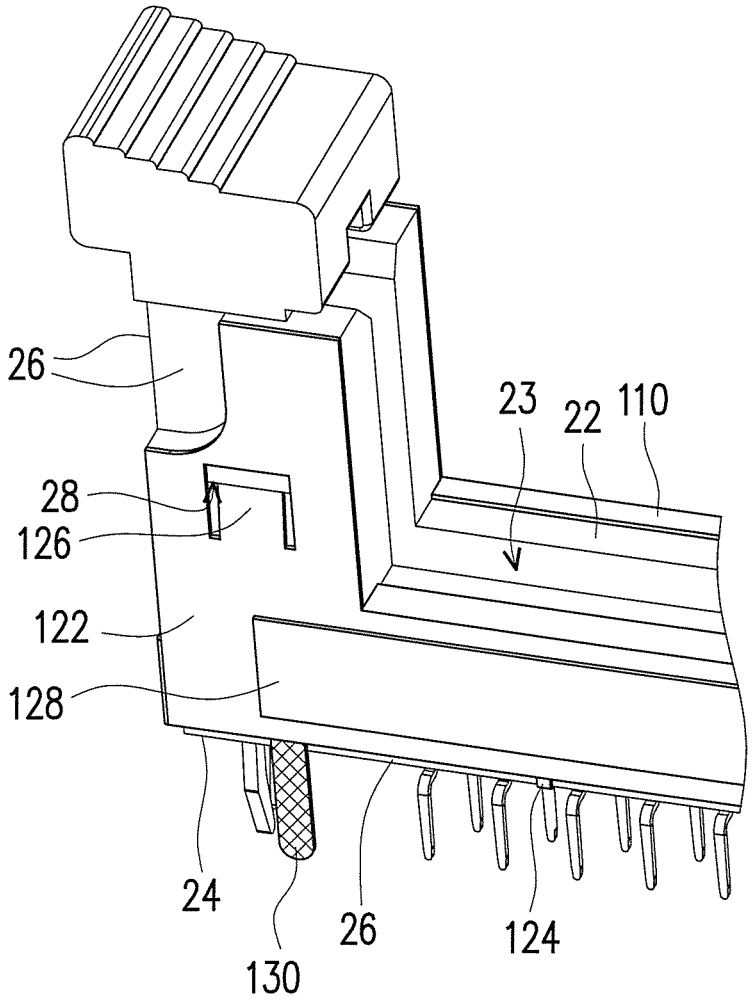
FIG. 5 is a partially enlarged schematic view of FIG. 1.
Figure 6:
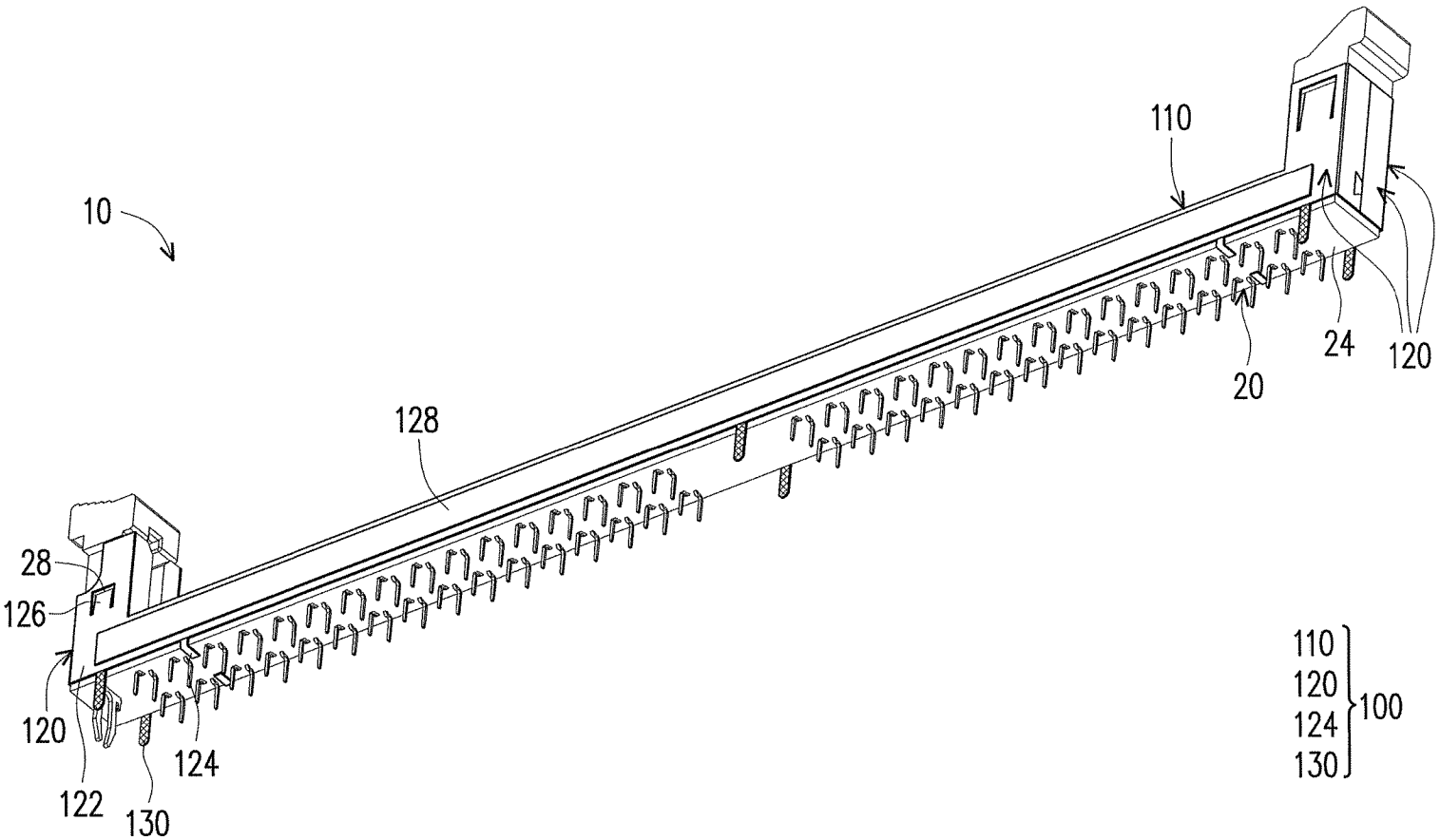
FIG. 6 is a schematic view of FIG. 1 from another perspective view angle.

FIG. 1 is a schematic view illustrating a connector assembly according to an embodiment of the invention. FIG. 2 is a schematic view illustrating a connector cover shown in FIG. 1. FIG. 3 is a partially enlarged schematic view of FIG. 1. FIG. 4 is a partial schematic cross-sectional view taken along line A-A of FIG. 3. FIG. 5 is a partially enlarged schematic view of FIG. 1. FIG. 6 is a schematic view of FIG. 1 from another perspective view angle. In the drawings of a connector assembly 10 according to an embodiment of the invention, lines illustrating a connector cover 100 are intentionally thickened, so as to clearly distinguish the connector cover 100 and a connector 20.

Referring to FIGS. 1 and 6, the connector assembly 10 of this embodiment includes the connector 20 and the connector cover 100. In this embodiment, the connector 20 is described as a memory module connector, for example. However, the type of the connector 20 is not limited thereto. The connector 20 is adapted to be fixed to a main board (not shown). The connector 20 includes a connector top surface 22 (shown in FIG. 1), a connector bottom surface 24 (shown in FIG. 6), and four connector laterals 26 (shown in FIGS. 3 and 5). The connector top surface 22 includes a connector slot 23. The connector slot 23 is configured for a memory module (not shown) to insert detachably, so that the memory module is electrically connected to the main board. The connector bottom surface 24 is opposite to the connector top surface 22. The connector laterals 26 are respectively connected to the connector top surface 22 and the connector bottom surface 24.

As shown in FIGS. 1 and 2, the connector cover 100 includes a cover top surface 110, four cover laterals 120, and at least one bending pin 124 (shown in FIG. 6), and at least one connecting pin 130. The cover top surface 110 covers the connector cover surface 22, and includes a cover slot 112 corresponding to the connector slot 24. More specifically, in this embodiment, a coverage of the cover top surface 110 only extends to an area near the connector laterals 26 with greater lengths on the connector top surface 22. Therefore, a width of the cover slot 112 of the cover top surface 110 is greater than a width of the connector slot 23, such that a portion of the connector top surface 22 is still exposed by the cover top surface 110. Certainly, in other embodiments, the cover top surface 110 may also cover the whole connector top surface 22 and only expose the connector slot 23. The cover top surface 110 is not limited thereto.

The four cover laterals 120 cover the four connector laterals 26. As shown in FIG. 1, the connector cover 100 approximately corresponds to a shape of the connector 20, so as to offer more complete protection to the connector 20. More specifically, the cover laterals 120 of the connector cover 100 at left and right ends have greater heights, and the two opposite cover laterals 120 of the connector cover 100 between the left and right ends (i.e., the central area) have greater lengths. The cover laterals 120 are connected to each other to form an enclosed rectangle. In this embodiment, the two cover laterals 120 having greater lengths are also taller at portions near the left and right ends, so as to cover laterals of a housing of the connector 20 near the two ends. Also, in this embodiment, the two cover laterals 120 having greater lengths are partially connected to the cover top surface 110. More specifically, since the connector 20 includes fasteners for fastening edges of the memory module at the two end, the cover top surface 110 does not extend to the portions of the connector 20 near the two ends. In other words, a length of the cover top surface 110 is slightly shorter than the length of the cover lateral 120 connected to the cover top surface 120, making the cover laterals 120 connected to the cover top surface 110 at areas other than the left and right ends.

In addition, as shown in FIGS. 5 and 6, in this embodiment, the at least one bending pin 124 extends from one of the cover laterals 110. The bending pin 124 is bent to lean against the connector bottom surface 24 for position limiting. In this embodiment, four bending pins 124 are provided, for example. The bending pins 124 are paired and respectively extend from the two opposite cover laterals 120 having greater lengths toward a direction away from the cover top surface 110. The paired bending pins 124 are bent toward each other's direction to lean against the connector bottom surface 24, so that the connector cover 100 is refrained from moving toward the top of the connector 20. Of course, in other embodiments, the bending pins 124 may also extend from the adjacent cover laterals 110, or in yet other embodiments, the bending pin 124 may only extend from one of the cover laterals 110. The invention does not intend to limit the number of the bending pin 124, the cover lateral 120 or cover laterals 120 where the bending pin 124 extends from, and whether the bending pins 124 are paired.

In the connector cover 100 of the connector assembly 10 of this embodiment, the connected cover laterals 120 cover the connector laterals 26 of the connector 20, such that the connector cover 100 is refrained from back-and-forth or lateral movement with respect to the connector 20. The cover top surface 110 covers the connector top surface 22, and the bending pins 124 lean against the connector bottom surface 24, such that the connector cover 100 is refrained from vertical movement with respect to the connector 20. Accordingly, the connector cover 100 is fixed to the connector 20 in the respective directions. Also, in this embodiment, a material of the connector cover 100 includes metal, for example. By covering the connector 20 with the metallic connector cover 100, an overall structural strength of the connector assembly 10 is enhanced, and the cover also prevents electromagnetic interference. However, in other embodiments, the material of the connector cover 100 is not limited thereto.

Besides, to further fix the connector cover 100 and the connector 20, one of the connector laterals 26 of the connector 20 may include a first fixing part 28, whereas one of the cover laterals 120 of the connector cover 100 includes a second fixing part 126 corresponding to the first fixing part 28. In this embodiment, as shown in FIGS. 1, 3, and 5, the portions of each of the connector laterals 26 having greater lengths near the ends include two first fixing parts 28, and the cover lateral 120 that the connector lateral 26 corresponds to also includes two second fixing parts 126 at corresponding positions, so as to fix the first fixing parts 28.

As shown in FIGS. 3 to 5, in this embodiment, the first fixing part 28 includes a recessed area, the second fixing part 126 includes a suspending tilting toward the opposite cover lateral 120. The suspending arm leans against an upper wall of the recessed area, such that the connector cover 100 is not easily moved upward and detached from the connector 10. Certainly, types and positions of the first fixing part 28 and the second fixing part 126 are not limited to above. Any possible structure falls within the scope of the invention as long as the structures are able to be used together to fix each other.

Besides, at least one connecting pin 130 extends from one of the cover laterals 120. More specifically, in this embodiment, the connector cover 100 includes six connecting pins 130. The connecting pins 130 are paired and respectively extend from the opposite cover laterals 120 toward the direction away from the cover top surface 110. The connector cover 100 of this embodiment is connected and fixed to the main board through the connecting pins 130. In other words, the connector cover 100 of this embodiment is able to be fixed to the main board together with the pins of the connector 20 by using the connecting pins 130 (by inserting the pins of the connector 20 and the connecting pins 130 into corresponding holes on the main board and filling soldering materials into the holes, for example), such that the connector cover 100 is more firmly disposed on the connector 20. Certainly, the number and positions of the connecting pins 130 are not limited thereto.

In this embodiment, the connecting pin 130 has a rough surface capable of enhancing adhesion of the soldering material. In this embodiment, the rough surface has a plurality of rhombus bumps, such that the surface is uneven and rough. The rough surface may be formed through pressing. However, in other embodiments, the connecting pin 130 may be scratched to form regular or irregular patterns on the connecting pin 130, so as to form the rough surface. Alternatively, the connecting pin 130 may be subjected to a sand blasting treatment to form the rough surface. A style of the rough surface on the connecting pin 130 and a formation process of the rough surface are not limited to above.

In other embodiments, a connection strength between the connecting pin 130 and the main board may also be enhanced in other ways. For example, a bending part that is pressed but not cut or a breach that is cut may be formed on the connecting pin 130 through pressing. When the connecting pin 130 is to be fixed to the main board, some soldering material may be at a location where the bending part is recessed or at the breach. Thus, the connection strength between the connecting pin 130 and the main board may be further enhanced.

It should be noted that, in this embodiment, the connecting pins 130 are grounding pins. In other words, when the connecting pins 130 are fixed to the main board, the connecting pins 130 contact a grounding wire of the main board, so as to be grounded. Namely, in addition to the fixing function, the connecting pin 130 of the connector cover 100 also offers protection against electromagnetic interference for the connector 20.

In addition, in this embodiment, a thickness of the connector cover 100 is limited to prevent an area on the main board from being reduced due to the connector cover 100 arranged on the connector 20. For example, in this embodiment, the thickness of the connector cover 100 is approximately 0.15 millimeters. However, since a metal plate with such thickness has a lower stiffness, the cover lateral 120 of the connector cover 100 is specifically designed to allow the connector cover 120 with a thinner thickness to have a strength sufficient to protect the connector 20.

Specifically, in this embodiment, each of the cover laterals 120 having greater lengths includes a plane 122 and a rib 128 protruding from the plane 122. Since the stiffness of a metal is increased after the metal is bent and pressed, the overall structural strength of the connector cover 100 of this embodiment is further facilitated by using the bent rib 128. Certainly, in other embodiments, the rib 128 may also be recessed with respect to the plane 122. Besides, even though each of the cover laterals 120 having greater lengths in this embodiment is provided with one longer rib 128, the cover lateral 120 may also be provided with a plurality of discontinuous ribs 128 in other embodiments. The type, number and position of the rib 128 shall not be construed as being limited to the drawings.

In view of the foregoing, in the connector cover of the connector assembly of according to the embodiments of the invention, the four connected cover laterals cover the four connector laterals of the connector, such that the connector cover is refrained from back-and-forth or lateral movement with respect to the connector. The cover top surface covers the connector top surface, and the bending pins lean against the connector bottom surface, such that the connector cover is refrained from vertical movement with respect to the connector. Accordingly, the connector cover is fixed to the connector in the respective directions. The connector cover may be further firmly connected to the main board through the connecting pins by soldering. The connector cover fixed to the connector and the main board effectively enhances the strength of the connector. In addition, the metallic material of the connector cover further reduces the signal interferences between the connector and other electronic components on the main board.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A connector cover, adapted to cover a connector and be fixed to a main board, wherein the connector comprises a connector top surface and a connector bottom surface opposite to each other and four connector lateral sides respectively connected to the connector top surface and the connector bottom surface, and the connector top surface comprises a connector slot, the connector cover comprising:

a cover top surface, adapted to cover the connector top surface and comprising a cover slot corresponding to the connector slot;

four cover lateral sides, adapted to cover the four connector lateral sides, wherein the two opposite cover lateral sides are connected to the cover top surface;

at least one bending pin, perpendicularly extending from one of the cover lateral sides and parallel to the cover top surface, wherein the at least one bending pin is adapted to be bent to lean against the connector bottom surface; and at least one connecting pin, extending from one of the cover lateral sides, wherein the connector cover is adapted to be connected to the main board through the at least one connecting pin, wherein at least one of the cover lateral sides comprises a plane and a rib protruding from or recessed with respect to the plane.

2. The connector cover as claimed in claim 1, wherein one of the connector lateral sides of the connector comprises a first fixing part, and one of the cover lateral sides of the connector cover comprises a second fixing part corresponding to the first fixing part.

3. The connector cover as claimed in claim 2, wherein the first fixing part comprises a recessed area, the second fixing part comprises a suspending arm tilting toward the opposite cover lateral side, and the suspending arm is adapted to lean against a wall of the recessed area.

4. The connector cover as claimed in claim 1, wherein the at least one connecting pin is a grounding pin.

5. The connector cover as claimed in claim 1, wherein each connecting pin has a rough surface, a bending part, or a breach, and the rough surface comprises a surface subjected to a sand blasting treatment or comprises a plurality of regular or irregular patterns or bumps.

6. A connector assembly, comprising:

a connector, adapted to be fixed to a main board and comprising:

a connector top surface, comprising a connector slot;

a connector bottom surface, opposite to the connector top surface; and four connector lateral sides, respectively connected to the connector top surface and the connector bottom surface; and a connector cover, comprising:

a cover top surface, covering the connector top surface and comprising a cover slot corresponding to the connector slot;

four cover lateral sides, covering the four connector lateral sides, wherein the two opposite cover lateral sides are connected to the cover top surface;

at least one bending pin, extending from one of the cover lateral sides, wherein the at least one bending pin is bent to lean against the connector bottom surface; and at least one connecting pin, extending from one of the cover lateral sides, wherein the connector cover is connected to the main board through the at least one connecting pin, wherein at least one of the cover lateral sides comprises a plane and a rib protruding from or recessed with respect to the plane.

7. The connector assembly as claimed in claim 6, wherein one of the connector lateral sides of the connector comprises a first fixing part, and one of the cover lateral sides of the connector cover comprises a second fixing part corresponding to the first fixing part.

8. The connector assembly as claimed in claim 7, wherein the first fixing part comprises a recessed area, the second fixing part comprises a suspending ann tilting toward the opposite cover lateral side, and the suspending arm is adapted to lean against a wall of the recessed area.

9. The connector assembly as claimed in claim 6, wherein each connecting pin is a grounding pin.

10. The connector assembly as claimed in claim 6, wherein each connecting pin has a rough surface, a bending part, or a breach, and the rough surface comprises a surface subjected to a sand blasting treatment or comprises a plurality of regular or irregular patterns or bumps.

* * * * *